United States Patent [19]

Evans

[11] 4,194,592

[45] Mar. 25, 1980

[54] LADDER STAND-OFF

[76] Inventor: Lewis L. Evans, 1408 Durant Ave., North Charleston, S.C. 29406

[21] Appl. No.: 880,560

[22] Filed: Feb. 23, 1978

[51] Int. Cl.[2] ..... E06C 7/48

[52] U.S. Cl. ..... 182/214; 182/229; 248/210

[58] Field of Search ..... 182/214, 107, 108, 226, 182/181, 186, 185, 229; 248/210, 238

[56] References Cited

U.S. PATENT DOCUMENTS

| | | | |
|---|---|---|---|
| 1,478,823 | 12/1923 | Gauss | 182/214 |
| 2,815,160 | 12/1957 | Gilmour | 182/214 |
| 2,993,562 | 7/1961 | Hussey | 182/214 |
| 3,212,606 | 10/1965 | Spaw | 182/186 |
| 3,419,109 | 12/1968 | Costlow | 182/214 |
| 3,828,889 | 8/1974 | Rehm | 182/107 |

FOREIGN PATENT DOCUMENTS

| | | | |
|---|---|---|---|
| 402538 | 12/1933 | United Kingdom | 182/214 |

*Primary Examiner*—Reinaldo P. Machado

[57] ABSTRACT

A ladder stand-off is provided wherein a pair of parallel braces are transversely connected to a pair of extending arms so that a ladder will pass through the space between the braces and arms and that, when the ladder is in use with the stand-off, each of the braces will bear against an opposite side of the ladder to support the upper end of the ladder.

2 Claims, 3 Drawing Figures

LADDER STAND-OFF

SUMMARY OF THE INVENTION

Ladders have been in use since antiquity. In spite of their long history and the many attempts at improvement, three primary problems still exist in the use of the ordinary ladder. These are:

Instability of the ladder, particularly as regards slipping of the upper part of the ladder where it contacts a supporting surface and turning of the ladder about one of the stiles when an unbalanced load on the ladder causes torque, possibility of damage to walls, gutters, eaves and other structures due to the small contact area of the stiles of the ladder, and inability to work under the ends of the ladder where it is in contact with a structure.

Numerous devices have been suggested toward solving these problems, however, few if any of theses devices have found wide spread usage due to their cumbersomeness, their expense, or their inconvience in use.

It is therefore the object of this invention to provide a simple, inexpensive, easy to use stand-off which will improve the utility of ladders in one or more of these problem areas.

In the drawings

DESCRIPTION OF THE INVENTION

Figure 1:
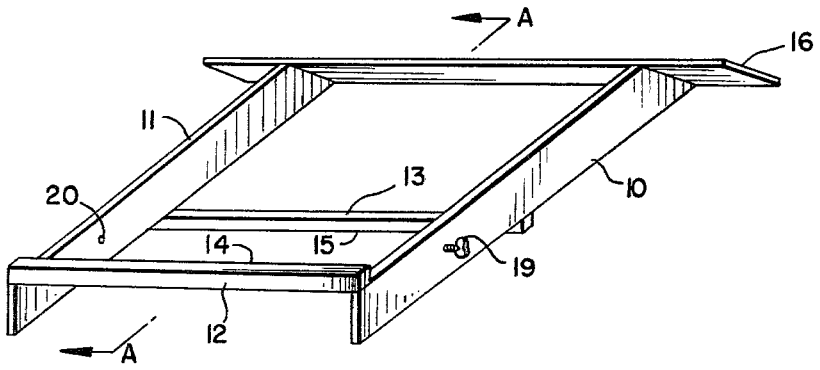
FIG. 1 is a perspective view of a preferred ladder stand-off of this invention.
Figure 2:
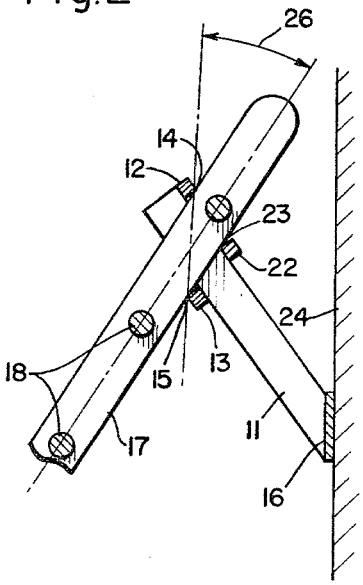
FIG. 2 is a side view taken in section A—A of a preferred stand-off in use with a ladder being supported against a vertical wall.
Figure 3:
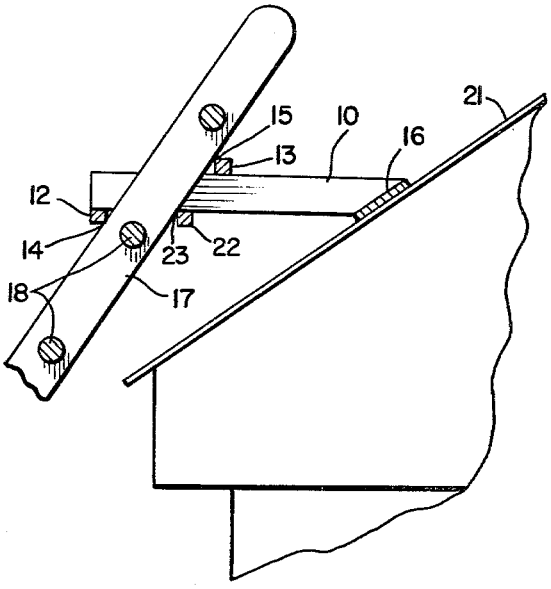
FIG. 3 is a side view taken in section A—A of a preferred stand-off in use with a ladder being supported against a sloping roof.

As illustrated, the stand-off is constructed with a pair of arms 10, 11 transversely connected to two braces 12, 13. The arms and braces are so spaced that the end of the ladder with which the stand-off is to be used will easily pass through the opening formed between these members. Specifically, the arms will be further apart than the width of the ladder and the braces will be further apart than the width of the stiles of the ladder.

To aid in raising and positioning of the ladder with the stand-off attached, means for fastening the stand-off to the ladder is desirable. This is provided by thumbscrews 19 which are threaded into holes 20 in both of the arms.

To improve ladder stability and reduce surface damage, a bearing member 16 is transversely attached to the ends of arms 10, 11. As shown, this bearing member is in the form of a flat plate canted on the end of the arms so that the plane of the plate is within 15 degrees of the plane defined by the bearing surfaces 14, 15 of braces 12, 13 respectively.

The procedure for setting up and using the stand-off with a ladder is as follows:

While the ladder is horizontal and resting on the ground, the stand-off is passed over the upper end of the ladder so that the ladder projects through the opening formed by the braces and arms. If the ladder is to be supported against a vertical surface, the stand-off will be passed over the ladder so that brace 13 is toward the lower end of the ladder and brace 12 is toward the upper end. Conversely, if the ladder is to be supported by a sloping surface, the stand-off is reversed or turned over so that brace 12 is toward the lower end of the ladder and brace 13 is toward the upper end.

In either case, the position of the stand-off is adjusted to the desired height on the ladder, generally within the area of the top four rungs, and the thumbscrews 19 tightened against the stiles enough to support the weight of the stand-off during raising and positioning of the ladder.

As the ladder is being raised the weight of the arms will cause the stand-off to rotate around the pivot points of the thumbscrews. With the stand-off in position for use against a vertical surface only a small amount of rotation will occur before the bearing surfaces 14 and 15 contact opposite sides of the stiles 17 of the ladder. The ladder can then easily be place into position with bearing member 16 in contact with the vertical wall 24.

When the ladder is being raised with the stand-off in position for use against a slpoing roof 21, the stand-off will rotate until the arms dangle in a vertical position since the braces will not contact the stiles of the ladder until the stand-off has almost doubled back upon the ladder. This will make positioning of the stand-off on the roof difficult. To eliminate this problem, a brace 22 may be added which will greatly restrict this rotation. This brace, in addition to helping in setting up of the ladder, will greatly increase the overall strength and rigidity of the stand-off.

When the ladder and stand-off are in position against a vertical surface, the forces created by the weight of the ladder and its load which must be carried by the upper end of the ladder will be transferred from the stiles 17 through braces 12, 13 to arms 10, 11 and thence through bearing member 16 to wall 24. The greater these forces are the greater will be the rotational forces exerted by the braces through their bearing surfaces 14, 15 against the opposing sides of the stiles and the tighter the stand-off will be "locked" to the ladder thus increasing the integrity of the overall structure.

When the stand-off is used against a vertical surface the greater width of bearing member 16 as compared to the width of the ladder greatly improves stability of the ladder against turning or pivoting. The large surface of the bearing member, particularly if equiped with a soft surface, will also greatly reduce any chances of scratching or scarring of the wall and reduce possible slipping of the ladder. Finally, as the ends of the stiles of the ladder are separated from the wall it is possible to work in this area without having to move the ladder.

The action and benefits of this system when used on a sloping roof are much the same as those described above and although the stand-off is upside down the bearing member 16 still rest more or less flush with the supporting surface. In this position, by keeping the stiles away from the easily damaged eaves and gutters, injury to these structures is avoided. Additionally, workmen can easily step from the rungs 18 around the stiles to the roof with greatly reduced danger of the ladder tilting or sliping.

It may be noted here that the stand-off can be used to secure a ladder on a steeply sloping roof without need for blocking or rigging. This is easily accomplished by hooking the stand-off over the ridge of of the roof and allowing the ladder to extend flush down the roof on on the opposite side of the ridge.

It should be obvious that many modifications of the stand-off as described above may be made without departing from the basic invention which resides in the novel arrangement of the braces and arms so that the bearing surfaces 14, 15 of the braces bear and "lock" against opposite sides of the stiles 17 to provide support for the upper end of the ladder. It will be noted that in this arrangement that the plane defined by the bearing surfaces in contact with the stiles will form an acute angle 26 with the plane defined by the longitudinal axes of the stiles of the ladder. For most applications this angle will be between 5° and 85° and preferrably will be between about 10° and 45°.

This angle is a function of the width of the stiles of the ladder and the spatial relationship of the braces. The spatial relationship of of the braces involves not only the absolute distance between them but also their positioning in relation to the central axes of the arms. The effect of changing the position of the braces in relation to the axes of the arms will be readily apparant by comparing the angle 26 formed between the planes of the ladder and bearing surfaces 14, 15 with the angle which is formed by the plane of the ladder and the plane passing through bearing surfaces 14 and 23. As will be obvious brace 13 could be replaced by brace 22 without any change in the function of the stand-off although the structure would be someshat weaker.

Although the reversability feature of the stand-off as illustrated provides great versitility in its use, the stand-off can be used with advantage if it is designed solely for use against a specific type of surface where it would be used repeatedly. In this case it may be desirable to more or less permenently attach the stand-off to the ladder such as by passing a rod through the arms of the stand-off and the stiles of the ladder.

The arms of the stand-off need not be straight, as shown, but may be bent or curved as may be desired to achieve a proper angle of contact of the bearing member 16 with the surface used to support the ladder.

Bearing member 16 may be eliminated with some loss in stability and possible increase in marring of surfaces. These factors can be partially overcome by flaring the arms out making their ends much wider than the width of the ladder and by covering these ends with suitable padding. Conversely, bearing member may be altered to meet a variety of specialized needs. It may be pivotably attached to the arms so that it will assume the plane of any surface it contacts. For use against round or irregularly shaped surfaces, bearing member 16 may be constructed of a flexible material such as reinforced rubber, thin metal, heavy fabric or the like so as to conform to the curvature or irregularities of these surfaces. In this latter case the arms should be flared out to improve stability.

The thumbscrews 19 are not essential and can be replaced by any suitable means for quickly attaching the stand-off to the ladder, such as, hooks attached to the braces for hanging over the rungs of the ladder, spring loaded rods through the arms which would fit into holes or notches in the stiles and even small notches appropriately spaced along the edges of the stiles for the bearing surfaces to fit into. Such devises may be entirely eliminated if the contact between the bearing surfaces and the stiles of the ladder has sufficient friction to prevent slippage of the stand-off during raising and positioning of the ladder.

In a preferred embodiment, the position of one or both of the braces is made adjustable. This is easily accomplished by attaching the braces to the arms with bolts which may pass through any of a series of holes. This will allow the stand-off to be used with ladders of differing stile widths and permit the adjustment of the angle formed by the arms to the ladder and to the supporting surface.

As should be obvious, the materials used in construction of the stand-off would be those used for the construction of ladders, i.e., wood, aluminum, magnesium alloy and the like which combine light weight and strength. Both materials used in construction and means used in securing the various parts together should be of a strength at least equal to that employed in the ladder with which the stand-off will be used.

I claim:

1. A stand-off for a ladder having a pair of stiles connected together by a plurality of rungs which comprises a pair of arms transversely connected by three braces each having a bearing surface substantially parallel to the others, said arms and braces forming an opening therebetween through which the ladder is positioned; two of braces being so arranged that when the ladder is in an upright position and supported at its upper end by the stand-off with the arms in contact with a supporting surface the bearing surfaces of these two braces will bear against opposite sides of the stiles and with the third brace so arranged as to restrict the movement of the stand-off when the ladder is unsupported by the stand-off.

2. A stand-off for a ladder having a pair of stiles connected together by a plurality of rungs which comprises a pair of arms transversely connected by two braces each having a bearing surface substantially parallel to the other and by a bearing member comprising a flat plate having a length greater than the width of the ladder with the plane of said plate forming an angle with the plane defined by said bearing surfaces of less than 15 degrees; said arms and braces forming an opening therebetween through which the ladder is positioned and being so arranged that when the ladder is in an upright position and supported at its upper end by the stand-off with the bearing member in contact with a supporting surface said bearing surfaces will bear against opposite sides of the stiles.

* * * * *